United States Patent [19]

Kametani et al.

[11] 3,980,470

[45] Sept. 14, 1976

[54] METHOD OF SPRAY SMELTING COPPER

[75] Inventors: Hiroshi Kametani, Tokyo; Chikabumi Yamauchi, Yokohama, both of Japan

[73] Assignee: National Research Institute for Metals, Tokyo, Japan

[22] Filed: Mar. 17, 1975

[21] Appl. No.: 559,152

[30] Foreign Application Priority Data

Mar. 30, 1974 Japan ..... 49-35173

[52] U.S. Cl. ..... 75/74; 75/76; 266/202

[51] Int. Cl.[2] ..... C22B 15/00

[58] Field of Search ..... 75/72, 74, 76, .5 B, 75/.5 R; 425/7; 266/34 R, 202

[56] References Cited

UNITED STATES PATENTS

| | | | |
|---|---|---|---|
| 2,870,485 | 1/1959 | Jones | 75/.5 B |
| 3,473,918 | 10/1969 | Foard | 75/74 |
| 3,558,120 | 1/1971 | Whetton et al. | 266/34 R |
| 3,687,656 | 8/1972 | Maelzer et al. | 75/74 |
| 3,765,866 | 10/1973 | Nayar | 75/.5 B |
| 3,890,139 | 6/1975 | Suzuki et al. | 75/74 |

FOREIGN PATENTS OR APPLICATIONS

| | | | |
|---|---|---|---|
| 1,450,718 | 7/1966 | France | 266/35 |

*Primary Examiner*—Walter R. Satterfield
*Attorney, Agent, or Firm*—Sherman & Shalloway

[57] ABSTRACT

In the method of smelting copper by melting a starting material of the group consisting of copper ore and roasted copper ore in a furnace along with a flux, separating from the melt a material of the group consisting of a matte and white metal which abound in cuprous sulfide, and thereafter smelting the separated matte or white metal with a member selected from the group consisting of oxygen and a oxygen-containing gas to convert same into blister copper, the improvement which comprises causing said matte or white metal to freely flow downwardly in a molten state and blowing a member selected from the group consisting of air, oxygen-enriched air and oxygen against the downwardly flowing stream of matte or white metal thereby dividing said stream of matte or white metal into fine particles as well as oxidatively smelting the matte or white metal to convert same into blister copper.

3 Claims, 2 Drawing Figures

METHOD OF SPRAY SMELTING COPPER

Figure 1:
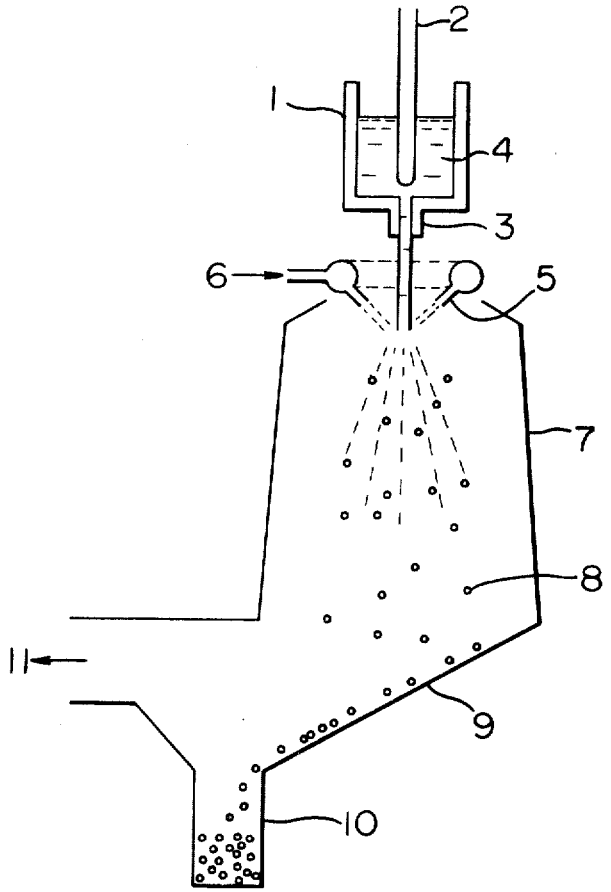

This invention relates to improvements in the method of obtaining blister copper by smelting copper matte.

The method of smelting copper known to date is that consisting of the following steps:

1. The raw ore or roasted ore is melted by heating it at an elevated temperature in a smelting furnace along with a flux to form a matte abounding in cuprous sulfide and slag, followed by separating and collecting the matte;
2. The matte is charged to a converter where air is blown into the molten matte to convert it to blister copper in accordance with the following reaction formula (1);

$$Cu_2S + O_2 \rightarrow 2Cu + SO_2 \qquad (1);$$

3. The molten blister copper is charged to a refining furnace where it is refined by the addition of a reducing agent to obtain a refined blister copper; and
4. The refined blister copper is cast into anodes and is electrolyzed using a copper sulfate solution as electrolyte and an electrolytic copper electrode as the cathode.

As the above-described method of smelting copper involves a number of steps wherein noxious waste gases are evolved, it is desired to lessen the number of these steps.

We previously developed a method of carrying out the electrolytical refining of blister copper by using an anodic electrolyte suspended with particles of blister copper, which method is referred to by us as the suspension electrolytic method [see U.S. Pat. No. 3,787,293 (1974)].

However, since in the foregoing method there is still used the blister copper formed in the converter, after comminuting it, the converter from which is evolved a great amount of $SO_2$ cannot be done away with. Again, for this reason the smelting cannot be carried out continuously.

It is therefore an object of this invention to provide a method of smelting copper by which can be produced the finely divided blister copper that is to be used in the aforesaid suspension electrolytic method.

Another object of the invention is to provide a method of smelting copper which does not use a converter and hence can carry out the smelting continuously.

The foregoing objects of the present invention can be achieved in the method of smelting copper comprising melting either a copper ore or roasted copper ore in a furnace along with a flux, separating from the melt a matte or white metal abounding in cuprous sulfide, and thereafter smelting the separated matte or white metal with either oxygen or an oxygen-containing gas to convert same to blister copper, by an improved method of the present invention which is characterized by causing said matte or white metal to freely flow downwardly in a molten state and blowing either air, oxygen-enriched air or oxygen against the downwardly flowing matte or white metal, thereby dividing said stream of matte or white metal into fine particles as well as oxidizing the matte or white metal to convert it into blister copper.

A novel aspect of this invention resides in the point that the conventional action of smelting in a converter and the comminution of the blister copper are carried out simultaneously by blowing either air, an oxygen-enriched air or oxygen against the stream of molten matte or white metal.

In consequence of the above-described invention method, it becomes possible to do away with the converting operation that was hitherto considered necessary. Hence, the smelting can be carried out continuously. Further, when the blister copper particles obtained by the method of this invention is used and pure copper is made by means of suspension electrolysis, it becomes possible to do away with the refining furnace also.

Hence, the invention method makes it possible to reduce the formation of the noxious waste gas to a minimum in smelting copper. In addition, as the concentration of the waste gas can be made constant by means of the continuous operation, the labor and equipment required for the treatment of the waste gas can be reduced.

Figure 2:
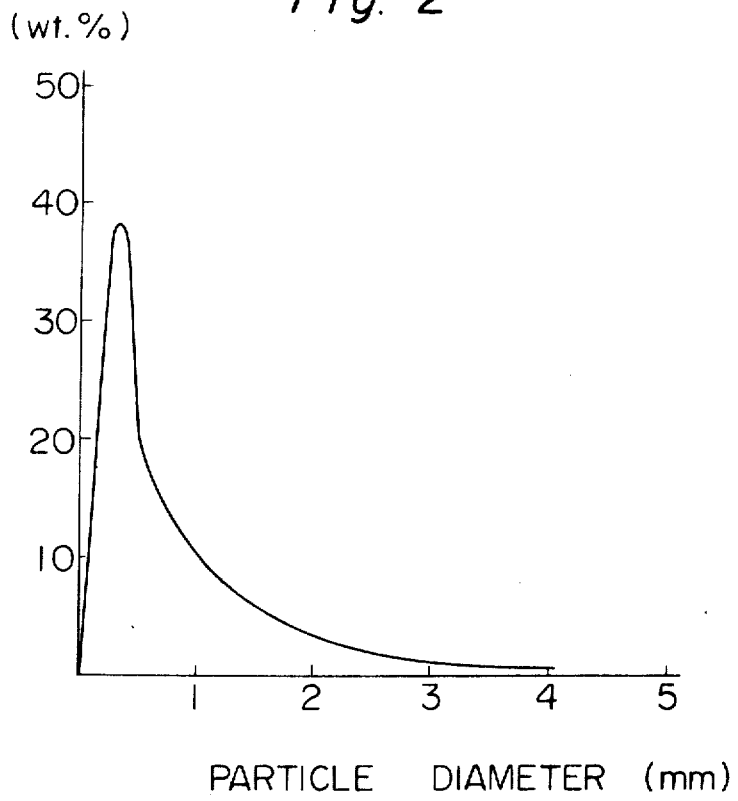

Of the accompanying drawings, FIG. 1 is a schematic drawing illustrating one mode of an apparatus suitable for preparing blister copper particles by means of the invention method, and FIG. 2 is a graph the curve of which shows the distribution of the particle size of the blister copper particles obtained by the method described in the present invention.

Next, referring to FIG. 1, one mode of specifically practicing the invention method will be described.

In the apparatus shown in FIG. 1 a molten white metal vessel 1 is disposed at the uppermost part of the apparatus. A stopper 2 is raised, and the white metal 4 is caused to flow downwardly out from a discharge port 3. Air, oxygen-enriched air or oxygen 6 is jetted out from nozzles 5 disposed below the vessel 1 and is blown against the stream of white metal to effect its atomization. The upper half of a furnace 7 is held at an elevated temperature ranging from 900° to 1200°C., and the atomized molten white metal is oxidized herein by the air, oxygen-enriched air or oxygen blown against it to be converted into molten blister copper particles. The lower half of the furnace 7 is maintained at a low temperature of below 900°C., and the molten blister copper particles are cooled here and solidified. The so prepared blister copper particles 8 fall onto a cooling plate 9 disposed at the lower end of the furnace 7 and are finally collected in a vessel 10. On the other hand, waste gas 11 can be conveyed from the bottom end of the furnace 7 to the side where the recovery of heat and the sulfur dioxide is carried out.

The reaction in which the atomized molten white metal particles are oxidized and converted to blister copper particles in the above-described method of this invention can be represented by the aforementioned reaction formula (1).

Accordingly, for atomizing the stream of molten white metal in accordance with the invention method a stoichiometric quantity based on the aforesaid reaction formula of oxygen, i.e., at least about 140 liters of pure oxygen under standard conditions per kilogram of white metal, is required.

It is necessary to ensure that the reaction of the atomized molten white metal particles in accordance with the aforesaid reaction formula takes place during the time the particles are falling. Hence, for accomplishing this, it is best to carry out the oxidation in a short period of time by enlarging the reactive surface area of the molten white metal particles by making them smaller. The diameter of the molten white metal particles is preferably not greater than 0.1 cm. The size of particles formed by the atomization becomes smaller in proportion as the flow velocity of gas at the atomization point, i.e., the point at which the center line of the stream of the falling white metal and the streams of the jetted gas meet, becomes greater. The flow velocity of gas at the atomization point should be adjusted to be preferably in the range of 3 meters per second to 100 meters per second, and more preferably from 5 meters per second to 50 meters per second. The velocity of gas at the atomization point can be adjusted by a suitable choice of the disposition, i.e., angle and distance, of the white metal nozzle and the gas nozzles.

The reaction between the molten white metal particles and oxygen in accordance with the aforesaid reaction formula is achieved extremely rapidly at elevated temperatures. Hence, the upper half of the furnace at which the contact between the molten white metal particles and oxygen takes place is preferably maintained at an elevated temperature. A temperature in the range of 900° – 1300°C. is preferred, still more preferred being a temperature in the range of 1000° – 1200°C.

The blister copper particles that are formed by the above reaction are preferably cooled and solidified during the time they are falling. To accomplish this, the lower half of the furnace is cooled to below 900°C., and preferably to below 700°C.

The foregoing heating of the upper half of the furnace can be suitably carried out by jetting the oxygen, air or oxygen-enriched air to be blown against the molten white metal particles, after heating same to 200° – 400°C. However, since a large amount of heat is evolved in concomitance with the aforesaid reaction of formula (1), there is hardly any need to apply heat to the furnace from the outside, especially when oxygen is used.

The cooling of the lower half of the furnace can be accomplished by natural cooling. The height of the furnace suitable for accomplishing the natural cooling, i.e., the distance from the gas jetting nozzles 5 to the cooling plate 9 ranges from about 3 to 6 times the inside diameter of the furnace. Further, the adjustment of the temperature of the lower half of the furnace can be readily achieved by adopting a method of cooling consisting of water cooling the furnace from the outside of the refractory thereof.

For preventing the accumulation of the particles formed, the inside diameter of the furnace is preferably enlarged towards the bottom of the furnace. Again, it is also possible to carry out the recovery of the reaction heat at the lower half (low temperature zone) of the furnace. The collection of the resulting copper particles can be carried out by oscillating the inclined cooling plate 9 with a vibrator. It is also possible to collect the particles by placing water at the lower end of the furnace or by flushing this part with water.

As iron, which accounts for a major proportion of the impurities contained in the molten white metal, is more easily oxidized than copper, its oxide phase is prepared, which separates from the copper phase and becomes deposited on the surface of the blister copper particles. Since this oxide phase separates from the copper particles by light attrition, it can be removed from the product by such known procedures as gravity concentration. Hence, even though the white metal contains a small amount of iron, no troubles arise from the standpoint of its use. Again, the unreacted white metal contained in the product can also be recovered by such known methods as gravity concentration.

The following examples are given for more fully illustrating the invention.

EXAMPLE 1

A furnace of the type shown in FIG. 1 having an atomization zone of inside diameter of 50 cm and a height of 150 cm was used, and the upper and lower halves of the furnace were held at 900°C. and 700°C., respectively, with electric heaters. In a crucible provided above the foregoing furnace was melted 5 kg of white metal by heating it up to 1150°C., which molten white metal was allowed to flow out downwardly at a rate of 1.0 kg per minute from a discharge port of inside diameter 2 mm provided at the bottom of said crucible. Commercial grade oxygen was jetted at a rate of 140 liters per minute (standard conditions) from 4 nozzles of inside diameter 2 mm against the foregoing stream of white metal at an inclined angle of 22.5° to cause the atomization of the latter. The flow velocity of oxygen at the atomization point was 18 meters per second. The resulting blister copper particles were collected in a collecting vessel via an inclined cooled plate.

The particle size distribution of the blister copper particles obtained after screening 2.83 kg of the particles obtained as described above (a part of the white metal was left in the crucible) showed that the maximum value of particle size distribution was at those of particle diameters 0.3 – 0.4 mm as shown in FIG. 2. Those of particle diameter 1.0 mm or less accounted for 64.7% of the particles. On the other hand, a major proportion of the particles of 3 mm or greater were lumps that had formed as a result of the sintering of small particles.

A chemical analysis of the starting white metal and that of the copper particles (partly intermixed with unreacted white metal particles) obtained are shown in Table 1, below.

Table 1

| | Analytical Values | | | |
|---|---|---|---|---|
| | Cu | Fe | S | Pb |
| Starting white metal | 72.9% | 2.5% | 18.7% | 1.84% |
| Blister copper particles | 87.7% | 0.57% | 9.4% | 2.22% |

The reaction rate of formula (1) as calculated from these values is 56%.

EXAMPLE 2

The experiment was carried out under identical conditions as in Example 1, except that for carrying out the atomization more effectively an improved oxygen nozzle was used. That is, for ensuring that the area of the point at which the stream of falling white metal and the jet stream of oxygen meet (atomization point) becomes as small as possible, the oxygen nozzle diameter was changed from 2 mm to 1 mm, the angle of the white metal stream to the gaseous jet stream was changed from 22.5° to 35°, and the velocity of the stream of oxygen at the atomization point was increased from 18 meters per second to 36 meters per second (the values being in all instance under standard conditions). A flow rate of the oxygen of 140 liters per minute was used as in Example 1. As a result, the maximum value of the particle size distribution of the blister copper particles formed was reduced to those of diameters 0.1 – 0.2 mm. On the other hand, the reaction rate increased to 73%.

EXAMPLE 3

The results obtained by carrying out the electrolysis of the blister copper particles obtained using the atomizing furnace in accordance with the present invention will be described.

The electrolytic cell was of disk-shape, divided by means of a partioning membrane (filter cloth) disposed horizontally therein into an anode chamber (the upper half) and a cathode chamber (the lower half). The anode chamber was provided with an anode made of Ti netting, an electrolyte outlet, a sample charging inlet and a thermometer, while the cathode chamber was provided with a bottom of Ti plate which serves as the cathode and an electrolyte inlet. Four hundred grams of the blister copper particles (those of diameters below 0.4 mm) obtained in Example 2 were placed in the anode chamber, while 400 grams of seed particles of pure copper (spherical and of about 0.3 mm diameter) were placed in the cathode chamber. An electrolyte containing 32 grams per liter of $Cu^{2+}$ *and* 100 grams per liter of $H_2SO_4$ was introduced to the cathode chamber at a flow rate of 30 milliliters per minute. In the meantime the electrolytic cell was subjected to vertical vibration (total vibratory width 0.6 mm, 1440 cycles per minute) and horizontal oscillations (eccentric radius of oscillation 12.5 mm, 180 cycles per minute), whereupon the particles in both chambers were kept in suspension in the electrolytes. The electrolysis was carried out in this state by causing a 30-ampere direct current to flow for 8 hours at a temperature of 40° – 50°C. The cell voltage was 1.2 – 1.5 volts. Four hours after initiation of the electrolysis, 150 grams of blister copper particles were additionally charged anew to the anode chamber.

After operating the electrolysis for 8 hours, the cathode current efficiency as calculated from the 268-gram increase in the weight of the pure copper particles in the cathode chamber was 94.7%, while the anode current efficiency as calculated from the decrease in the weight of the total blister copper particles charged to the anode chamber was 99.8%. The valve of S that was analyzed in the matured particles of pure copper obtained in this case was 0.001%.

What is claimed is:

1. An improved method of forming blister copper particles, suitable for use in an electrolytic refining process, from the cuprous sulfide rich matte or white metal obtained in the smelting of copper ore by melting raw copper ore or roasted copper ore with a flux in a furnace and separating the cuprous sulfide rich matte or white metal from the melt, said method comprising causing said matte or white metal containing cuprous sulfide to freely flow downwardly in a molten state, and blowing oxygen, air or oxygen-enriched air in an amount, measured in terms of oxygen, at least equal to the stoichiometric quantity necessary to completely oxidize the cuprous sulfide contained in the matte or white metal according to the reaction formula $$Cu_2S + O_2 \rightarrow 2Cu + SO_2$$

at a flow velocity in the range of from 3 meters per second to 100 meters per second against the downwardly flowing stream of matte or white metal at a temperature in the range of from 900°C. to 1300°C.;

thereby simultaneously dividing the stream of matte or white metal into fine particles and oxidatively smelting the fine particles of matte or white metal to obtain finely divided molten blister copper particles of relatively narrow size distribution.

2. The method of claim 1 wherein said flow velocity is in the range of from 5 meters per second to 50 meters per second and the temperature is in the range of from 1000°C. to 1200°C.

3. The method of claim 1 which comprises cooling and solidifying the finely divided, oxidatively purified molten blister copper and thereafter collecting the solid particulate blister copper.

* * * * *